United States Patent [19]

Hudnall

[11] 4,076,201

[45] Feb. 28, 1978

[54] ADJUSTABLE CHAIR-SPINDLE ASSEMBLY

[76] Inventor: Walter E. Hudnall, 2157 W. 236th Place, Torrance, Calif. 90501

[21] Appl. No.: 767,375

[22] Filed: Feb. 10, 1977

[51] Int. Cl.[2] ..... F16M 11/00

[52] U.S. Cl. ..... 248/162; 248/412; 248/402

[58] Field of Search ..... 248/399–403, 248/161, 162, 407–409, 411, 412, 354 C; 297/345

[56] References Cited

U.S. PATENT DOCUMENTS

| | | | |
|---|---|---|---|
| 2,710,048 | 6/1955 | Dawson | 248/412 |
| 2,851,126 | 9/1958 | Ward | 248/412 X |
| 3,201,079 | 8/1965 | Doetsch | 248/412 |
| 3,228,647 | 1/1966 | Musianowycz | 248/412 |
| 3,865,341 | 2/1975 | Fortnam et al. | 248/412 X |

FOREIGN PATENT DOCUMENTS

| | | | |
|---|---|---|---|
| 890,311 | 9/1953 | Germany | 248/400 |
| 2,035,950 | 2/1972 | Germany | 248/407 |
| 2,040,804 | 3/1972 | Germany | 248/161 |
| 2,233,390 | 1/1974 | Germany | 248/412 |
| 158,451 | 4/1957 | Sweden | 248/408 |
| 168,984 | 9/1934 | Switzerland | 297/345 |

*Primary Examiner*—Lawrence J. Staab
*Attorney, Agent, or Firm*—Francis X. LoJacono

[57] ABSTRACT

An adjustable chair-spindle assembly including the combination of a pneumatic and mechanical index mechanism which controls the height displacement of a seat supported by the assembly. By operating a hand lever positioned below the seat, the mechanical index mechanism is released from a locked arrangement, allowing the seat to be raised or lowered at a controlled rate by the pneumatic mechanism. The index mechanism comprises an index housing having a lift tube secured thereto which is operated by the handle lever, wherein the linear movement of the index housing allows the index and bearing balls to be disengaged from a locked position. Movement of the index balls permits the bearing balls to be released from annular grooves formed in the index spindle by allowing index rings to shift upwardly, at which time the seat of the chair is free to be adjusted upwardly or downwardly—the chair being spring-loaded to carry the weight of the seat in order for it to lift up, or it may be moved down by adding force to the seat. When the handle is released, the chair will lock into the selected position.

7 Claims, 8 Drawing Figures

ADJUSTABLE CHAIR-SPINDLE ASSEMBLY

BACKGROUND OF THE INVENTION

1. Field of the Invention

This invention relates to chairs of the type generally used in offices and, more particularly, to a device whereby the seat of the chair can be adjusted for height under controlled conditions.

2. Description of the Prior Art

As is well known in the art, various problems and difficulties are encountered in providing suitable means for adjusting the height of seats mounted to support structures, particularly where the seat is very heavy.

Many types of adjusting devices are used and are found to be generally inadequately designed to allow most individuals to adjust their chairs without assistance of others or the need of tools. Hence, these devices have features that restrict their use; and they are complicated to operate and become expensive to maintain in working order. The most common height-adjusting means comprises a main support structure having a tubular housing to receive an elongated, threaded spindle which is secured to the chair seat. An adjustable nut housing is threadably received over the threaded spindle and rests on the tubular support structure.

The height of the chair is controlled by rotating the nut housing to a selected point along the spindle and then looking it in place by a set screw. However, this well-known arrangement is not simple to operate due to the weight and the various overall designs of different chairs.

One must turn the chair over and try to adjust the seat to the desired height or request help from someone else, whereby two people are needed to accomplish the simple task of raising and lowering the seat of a chair.

However, the following description of the applicant's invention will show how the above problems have been overcome.

SUMMARY OF THE INVENTION

The present invention comprises an adjustable chair spindle assembly having in combination a mechanical index mechanism to provide the locking and releasing of the chair to a selective height, and a pneumatic mechanism to control the movement of the chair when the mechanical index is operated.

The mechanical index mechanism is operated by a hand lever or handle positioned below the seat of the chair and, as the handle is raised, the index housing is also raised—the handle being secured to the lift tube of the index housing. As the index housing is raised, index balls disengage from index rings which are allowed to raise, wherein bearing balls separate from annular grooves formed in the main index-spindle support in the chair-support structure. Thus, the seat of the chair can be raised or lowered to a selected position.

However, the seat is spring-biased in an upward direction, thereby causing the seat to rise upwardly at a rate controlled by the pneumatic mechanism defined by a piston being slidably disposed in a pneumatic spindle. If, however, the seat is to be lowered, force is applied in a downward direction as the handle is moved downwardly. One needs only to overcome the upward force of the biasing spring and the seat will slide downwardly over the index spindle at the controlled rate of the pneumatic mechanism, without the need of extra help or tools. The handle is simply released when the seat reaches the desired position.

OBJECTS AND ADVANTAGES OF THE INVENTION

The present invention has for an important object a provision wherein a seat of a chair can be readily positioned at any desired height by the simple operation of a handle or hand lever that will allow the seat to move either upwardly or downwardly at a controlled rate, wherein the handle operates the combined mechanical and pneumatic mechanisms arranged therein.

It is another object of the invention to provide an adjustable chair-spindle assembly that is so designed as to accept a wide variety of seats, without changes to the device.

It is still another object of the invention to provide an adjustable chair-spindle assembly that includes a mechanical index comprising index balls and bearing balls arranged as releasable locking means actuated by the simple movement of a handle.

It is a further object of the invention to provide an assembly of this character that includes a pneumatic device to control the rate of upward and downward movement of the chair seat, no matter how heavy the seat might be.

Still another object of the invention it to provide a device of this character that is uncomplicated and rugged in construction, yet simple to operate.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or modes of operation that are properly within the scope of the appended claims.

DESCRIPTION OF THE DRAWINGS

Referring more particularly to the accompanying drawings, which are for illustrative purposes only.

DESCRIPTION OF THE PREFERRED EMBODIMENT

Figure 1:
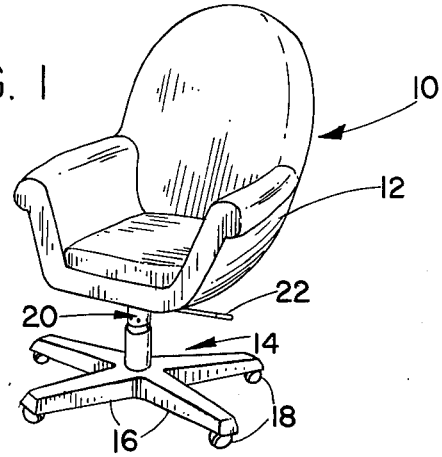
FIG. 1 is a pictorial view of a chair having a suitable seat secured to the present invention.
Figure 2:
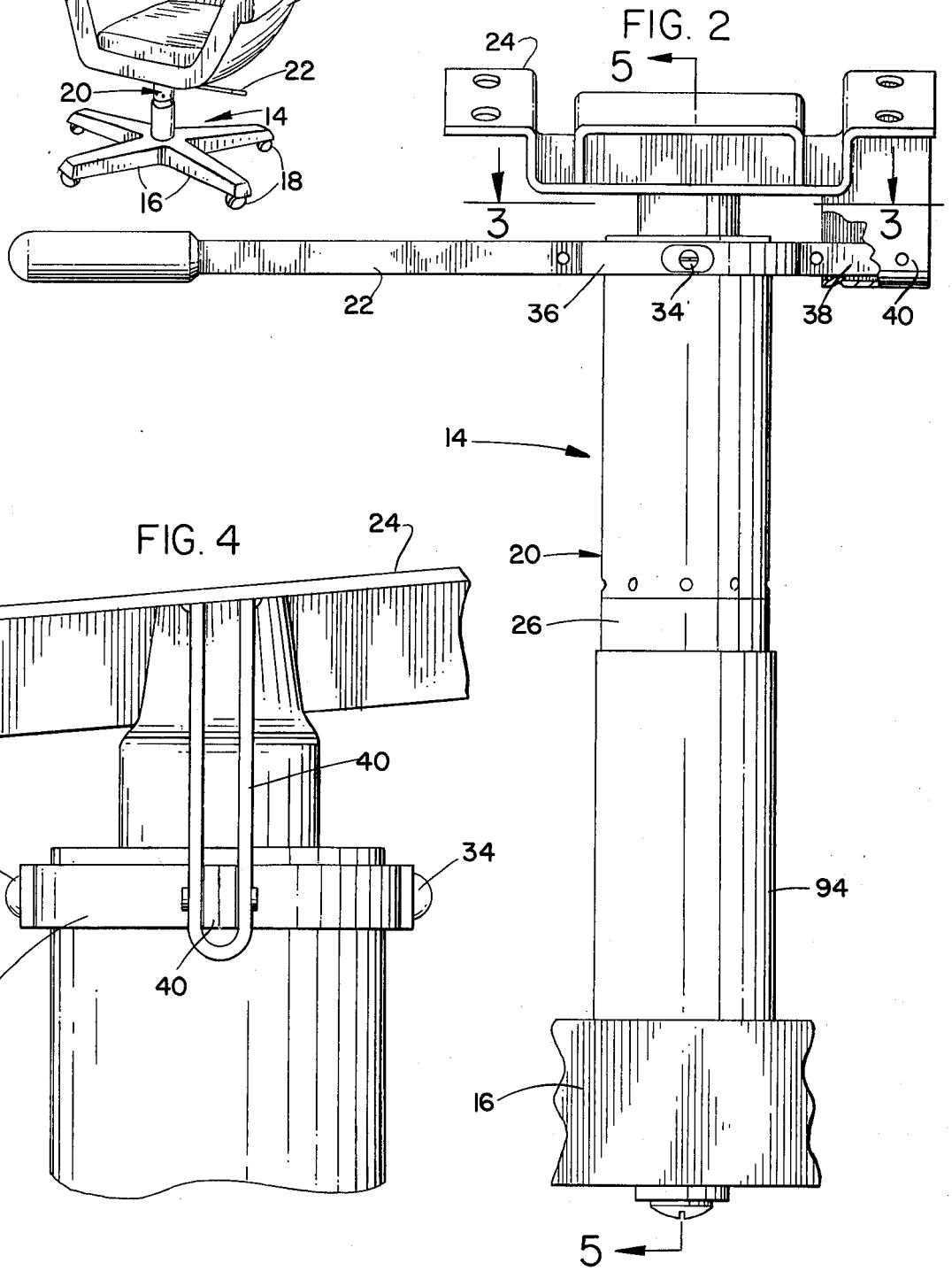
FIG. 2 is an enlarged, side-elevational view of the assembly, without a seat attached thereto.
Figure 4:
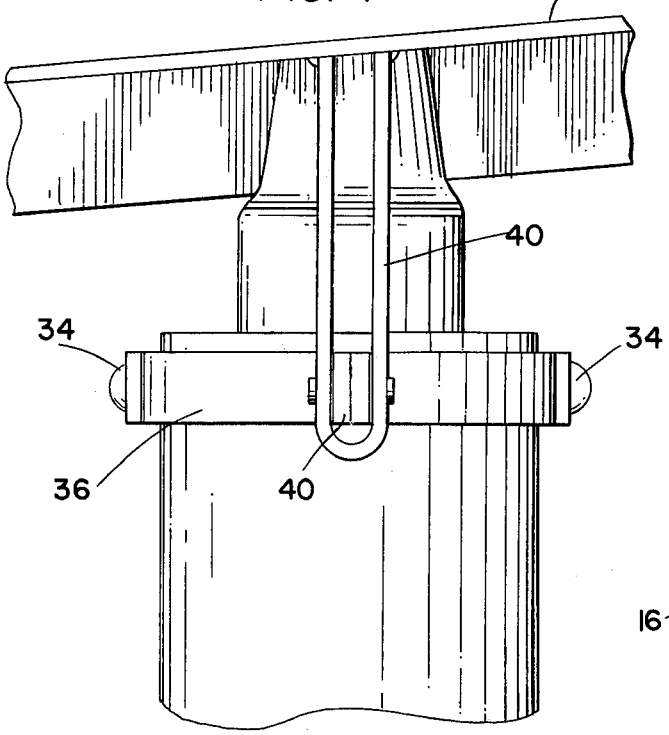
FIG. 4 is an enlarged, end view of the upper position of the assembly.
Figure 5:
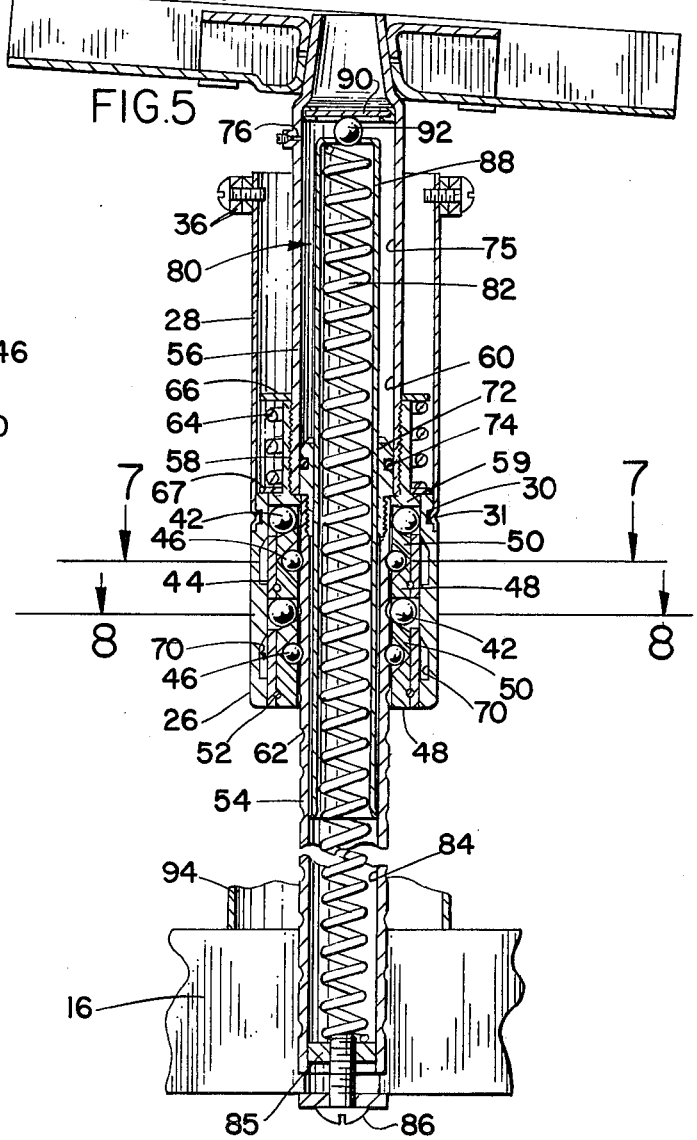
FIG. 5 is a cross-sectional view taken along line 5—5 of FIG. 2.

Referring now to the drawings and more particularly to FIG. 1, there is shown a chair, generally indicated at 10, having a suitable seat 12 mounted and secured to the chair-support structure designated at 14, which generally includes legs 16 having rollers 18. Formed as part of the chair-support structure is the present invention defined as an adjustable spindle assembly 20 including an operating hand lever or handle 22. The support structure also includes a suitable seat-support bracket 24, which is seen in FIGS. 2, 4, and 5. Thus, it should be understood that various designed seat units may be adapted for use with the present invention; and, therefore, a detailed description thereof is not deemed necessary to form an understanding of the present device.

As is shown in the various figures, the adjustable chair-spindly assembly comprises an index housing 26 having an upwardly extending lift tube 28—the lift tube being secured to index housing 26 in any suitable manner, but is herein shown as being secured by an annular channel 30 disposed in housing 26 that is adapted to receive an annular rib 32 formed in tube 28.

The upper open end of tube 28 is pivotally connected to handle 22, so as to position the operating handle just under seat 12, as seen in FIG. 1. Screw 34 provides the securing-pivot point so that index housing 26 can be raised. In this particular arrangement, handle 22 includes a yoke 36 having tongue member 38 pivotally mounted to hinge bracket 40, hinge bracket 40 being secured to seat-support bracket 24, as illustrated in FIGS. 2 and 4.

There is provided an index-release means which is controlled by the upward and downward movement of index housing 26. Said index-release means comprises a plurality of index balls 42 movably positioned within a thrust collar 44. In this particular arrangement, two sets of index balls are provided to be received in thrust collar 44 so as to be associated with respective sets of locking-ball assemblies. Each locking-ball assembly comprises a plurality of bearing balls 46 which are located in a raceway formed by retaining ring 48 and slidable-index ring 50, each retaining ring 48 being secured in place by restraining ring 52, thereby limiting the movement of index balls 42.

Thus, it can be seen that index balls 42 are held in place between the index housing 26 and the main central index spindle 54, wherein bearing balls 46 are restrained in raceways formed by retainer rings 48, slide index rings 50, and index spindle 54.

It should be understood that index thrust collar 44 is relatively fixed by being secured to the central support strut 56, the collar having an extended neck member 58 with a reduced diameter that is threadably connected to said strut 56. Thus, thrust collar 44 is fixed with respect to the movement of index housing 26. The lower portion of collar 44 comprises an enlarged-diameter, annular body whereby an abutting shoulder 59 is arranged therebetween.

Accordingly, the central support strut 56 is slidably mounted over index spindle 54 in a telescoping manner, wherein said spindle is received in bore 60 of strut 56 and normally locked in a selected position therein, the locked position being shown in FIG. 5. Hence, index housing 26, strut 56, and their related components are directly secured to the chair seat 12; and spindle 54 is directly secured to the chair-support structure 14, said chair seat being vertically adjustable in height with respect to said support structure 14 when said lever 22 is lifted upwardly.

Figure 8:
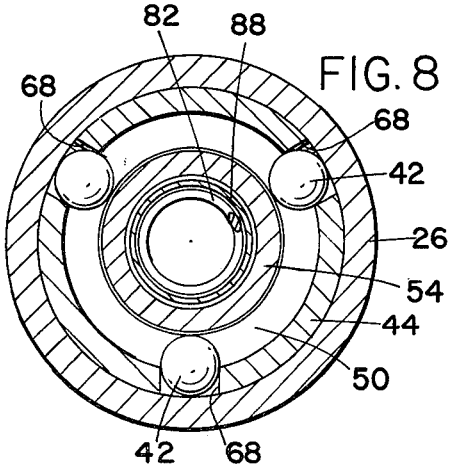
FIG. 8 is an enlarged cross-sectional view taken along line 8—8 of FIG. 5, showing the arrangement of the index balls.

We will refer to FIG. 5 in which the assembly is shown in a normally locked position. That is, bearing balls 46 are locked in engagement with selective annular channels or grooves 62 that are formed in said spindle and equally spaced apart to accommodate various positions of said chair. The locking arrangement of said bearing balls into grooves 62 is primarily caused by biasing spring 64, which causes index housing 26 to be forced downwardly. Spring 64 is positioned within lift tube 28 and is arranged to be disposed between index housing 26 and keeper ring 66, said keeper ring being affixed to strut 56. The upper end of spring 64 abuts keeper ring 66; and the lower end thereof abuts washer ring 67 which rests on the upper annular edge of housing 26, thereby biasing housing 26 downwardly to a point limited by annular shoulder 59 of index collar 44. Thus, the inner annular surface of said collar 44 acts as a cam forcing index balls 42 inwardly through respective apertures 68, best seen in FIG. 8. As index balls 42 are received inwardly thereof, they engage the upper inclined surface of said slidable index ring 50, causing ring 50 to be forced downwardly against bearing balls 46. Index ring 50 also includes a lower, inclined wall surface which engages bearing balls 46, moving them inwardly and downwardly over the inclined surface of said retaining ring 48. This then causes each bearing ball to be received in grooves 62, thereby preventing any vertical, longitudinal movement along spindle 54.

Figure 6:
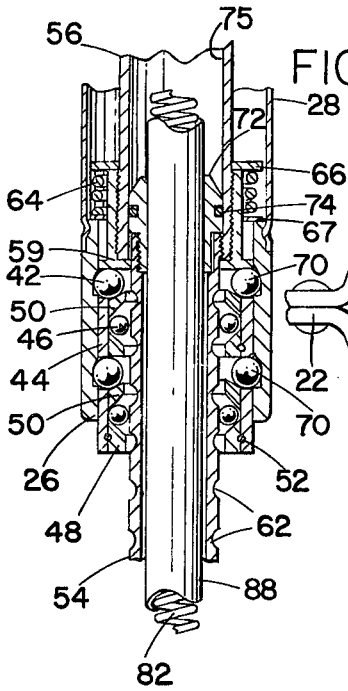
FIG. 6 is a cross-sectional view showing the mechanical index assembly in a released mode of operation.
Figure 3:
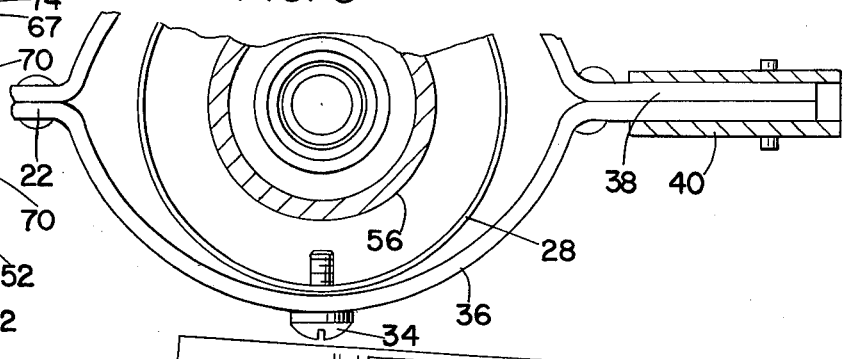
FIG. 3 is a partial, cross-sectional view taken along line 3—3 of FIG. 2, showing the arrangement of the hand lever to operate the assembly.
Figure 7:
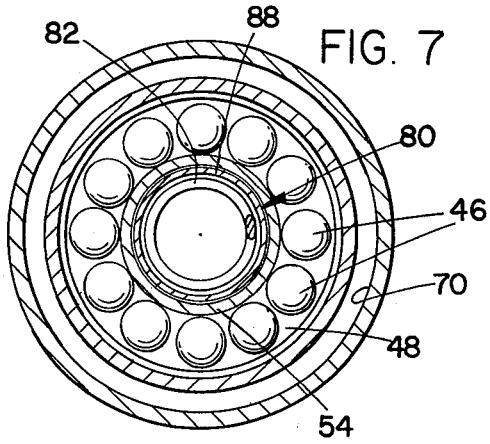
FIG. 7 is an enlarged, cross-sectional view taken along line 7—7 of FIG. 5.

Accordingly, when the chair is to be repositioned as to height, lever handle 22 is lifted upwardly, causing housing 26 to move upwardly therewith, as seen in FIG. 6. When index housing reaches a position having its inner annular channels 70 adjacent index balls 42, said balls are then released to pass outwardly through apertures 68 into channels 70. This then allows bearing balls 46 to disengage from grooves 62, forcing slidable rings 50 upwardly to insure movement of index balls 42. At this time, the chair seat and spindle assembly 20 are released from index spindle 54, thereby permitting the chair to be repositioned to a selective height.

In order to prevent excessive movement of the chair with respect to the chair-support structure, there is included a pneumatic-control means which comprises a piston 72 having an annular sealing ring 74 received within a piston chamber 75 defined by the tubular-support strut 56. When the chair is to be lowered to another position the assembly is released and disengaged, at which time force is applied downwardly to the seat—such as when someone sits thereon. The air captured in chamber 60 is slowly released through an adjustable two-way valve 76.

However, if the chair is to be raised, no pressure is externally applied. The upward movement of the chair seat is caused by an internally arranged biasing means, generally indicated at 80, wherein the biasing means comprises a compression spring 82 supported within bore 74 of spindle 54, wherein the lower end of spindle 54 is provided with a closure member 85. This closure member has two functions—one to support spring 82 and two to provide a connecting means for the spindle to be fixed to the support structure by bolt 86, as seen in FIG. 5. The upper portion of spring 82 is covered by a spring-guide member 88 which is received through piston head 72 and into bore 84 of spindle 54 having its upper free end disposed in chamber 75.

Interposed between the closed end of guide 88 and piston-chamber seal 90 is a support bearing 92, whereby the upward force of spring 82 forces bearing 92 against seal 90, overcoming the weight of the chair seat 12, thereby allowing the seat to rise to a selective position along spindle 54 at a rate of movement determined by the pneumatic control means.

A protective tubular cover 94 may be positioned over the lower structure, as seen in FIGS. 1 and 2.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example, and I do not wish to be restricted to the specific form shown or uses mentioned, except as defined in the accompanying claims.

I claim:

1. An adjustable chair spindle apparatus to selectively position the height of a chair seat mounted to the chair-support structure, said apparatus comprising:

a central index spindle fixedly secured to said chair-support structure, wherein said central index spindle includes a plurality of annular grooves equally spaced apart along the longitudinal length thereof;

positioning selective means arranged to be slidably mounted on said index spindle in a releasable locking arrangement, said positioning selective means comprising a central, tubular support strut arranged to be attached to said chair seat at one end thereof;

a lever-actuating means operably connected to said positioning selective means, to allow said selective means to be released from a locked condition with said index spindle;

pneumatic means within said positioning selective means to control the rate of vertical movement between said chair seat and said support structure; and wherein said releasable locking means comprises:

a thrust collar secured to said support strut having a plurality of apertures disposed therein;

at least one set of index balls arranged within said thrust collar so as to pass through said apertures to engage said index housing;

at least one index ring slidably positioned between said thrust collar and said spindle, said index ring having oppositely disposed, inclined walls wherein one inclined wall thereof engages said index balls;

at least one restraining ring positioned between said thrust collar and said spindle, said restraining ring being secured to said thrust collar and having an inclined wall adjacent said inclined wall of said index ring, thereby defining a raceway therebetween; and at least one set of bearing balls disposed in said raceway for engagement within said annular grooves of said spindle to provide a vertical locking arrangement between said central, tubular support strut and said spindle to prevent vertical movement therebetween, and wherein said index housing includes at least one annular recess therein adjacent said thrust collar to receive said index balls therein when said index housing is raised to release said locking means.

2. An adjustable chair-spindle apparatus as recited in claim 1, wherein said pneumatic means comprises:

a chamber formed within said support strut member having an upper seal member secured therein;

a piston head slidably received in said chamber and affixed to said index spindle; and a two-way valve member arranged within said strut member to control the rate of movement of said chair seat in an upward or downward, vertical travel over said spindle.

3. An adjustable-chair spindle apparatus as recited in claim 1, wherein said apparatus includes a second biasing means centrally disposed within said strut member and said index spindle, whereby upward force is continuously applied to said chair seat, whereby said chair seat is allowed to rise vertically when said lever means is actuated; and whereby downward force must be applied to move said chair seat downwardly, overcoming the force of said biasing means.

4. An adjustable chair-spindle apparatus as recited in claim 3, wherein said second biasing means comprises:

an elongated spring member having the lower end thereof supported in said index spindle, and an upper end received in said chamber;

a guide cover disposed over the upper end of said spring member; and a bearing member interposed between said guide cover and said upper seal member of said chamber.

5. An adjustable chair-spindle apparatus as recited in claim 4, wherein said apparatus includes a chair-seat-support bracket mounted to said support strut.

6. An adjustable chair-spindle apparatus as recited in claim 5, wherein said index housing includes a lift-tube member secured thereto and being operably connected to said lever-actuating means, wherein said lever-actuating means comprises:

an elongated handle pivotally connected intermediate the ends thereof to said lift-tube member; and a hinge bracket mounted to said seat-support bracket having one end of said handle hingedly attached thereto.

7. An adjustable chair-spindle apparatus as recited in claim 1, wherein said annular recess in said index housing includes an annular cam surface to cause forceable engagement between said index housing and said slidable index ring.

* * * * *